US008381328B1

(12) United States Patent
Anderson

(10) Patent No.: US 8,381,328 B1
(45) Date of Patent: Feb. 26, 2013

(54) SPA MANICURE APPARATUS

(76) Inventor: Anita Y. Anderson, Long Beach, CA (US)

( * ) Notice: Subject to any disclaimer, the term of this patent is extended or adjusted under 35 U.S.C. 154(b) by 683 days.

(21) Appl. No.: 12/613,335

(22) Filed: Nov. 5, 2009

(51) Int. Cl.
*A47K 3/022* (2006.01)

(52) U.S. Cl. ..... 4/621; 4/639; 4/541.1; 132/73.5; 610/17

(58) Field of Classification Search ..... 4/621, 622, 4/639, 640, 642; 132/73–75
See application file for complete search history.

(56) References Cited

U.S. PATENT DOCUMENTS 4,057,053 A 11/1977 Kunz
4,307,738 A * 12/1981 Barns ..... 132/74.5
D278,367 S 4/1985 Sussman
5,947,131 A * 9/1999 Kim ..... 132/200
6,183,427 B1 * 2/2001 Ishii ..... 601/46
6,309,366 B1 10/2001 Maxwell
6,695,800 B1 2/2004 Gary et al.
6,725,471 B2 4/2004 Ferber et al.
6,973,683 B2 12/2005 Lev et al.
7,165,555 B2 1/2007 Lee
2006/0225756 A1 * 10/2006 Ceccarini ..... 132/73

* cited by examiner

*Primary Examiner* — Huyen Le
*Assistant Examiner* — Christine Skubinna

(57) ABSTRACT

The present invention features a spa manicure apparatus 100 for providing comfort to a user's hands during a manicure comprising a housing 200; a right basin 400 and a left basin 300 for retaining a solution 700 disposed in the housing 200; a wrist rest 600 disposed on the basins; a heating element 450; and a massaging element.

1 Claim, 3 Drawing Sheets

SPA MANICURE APPARATUS

FIELD OF THE INVENTION

The present invention is directed to a spa manicure device. More particularly, the present invention is directed to a spa manicure device for warming and/or massaging hands or wrists during a manicure.

BACKGROUND OF THE INVENTION

As part of the manicure process, it is often desirable to soften the cuticles so that they may be removed or pushed back. One method to accomplish this involves soaking the fingers in a warm solution (e.g., warm water) in a bowl. However, the contents of the bowl quickly cool.

The present invention is directed to an apparatus for assisting in the preparation of hands, cuticles, and/or the like during a manicure process. The present invention allows a user to submerge both his/her hands into a warmed solution for an extended period of time without needing to replace the solution.

The present invention features a spa manicure apparatus for providing comfort to a user's hands during a manicure. The spa manicure apparatus comprises a housing having a right basin and a left basin disposed in the housing. Each basin can retain a solution and is for accepting the user's hands. The spa manicure apparatus further comprises a wrist rest disposed on rim of the left basin and the right basin. A heating element for heating the solution retained in the basins is disposed in the housing, and a massaging element for massaging the user's hands is disposed in the housing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
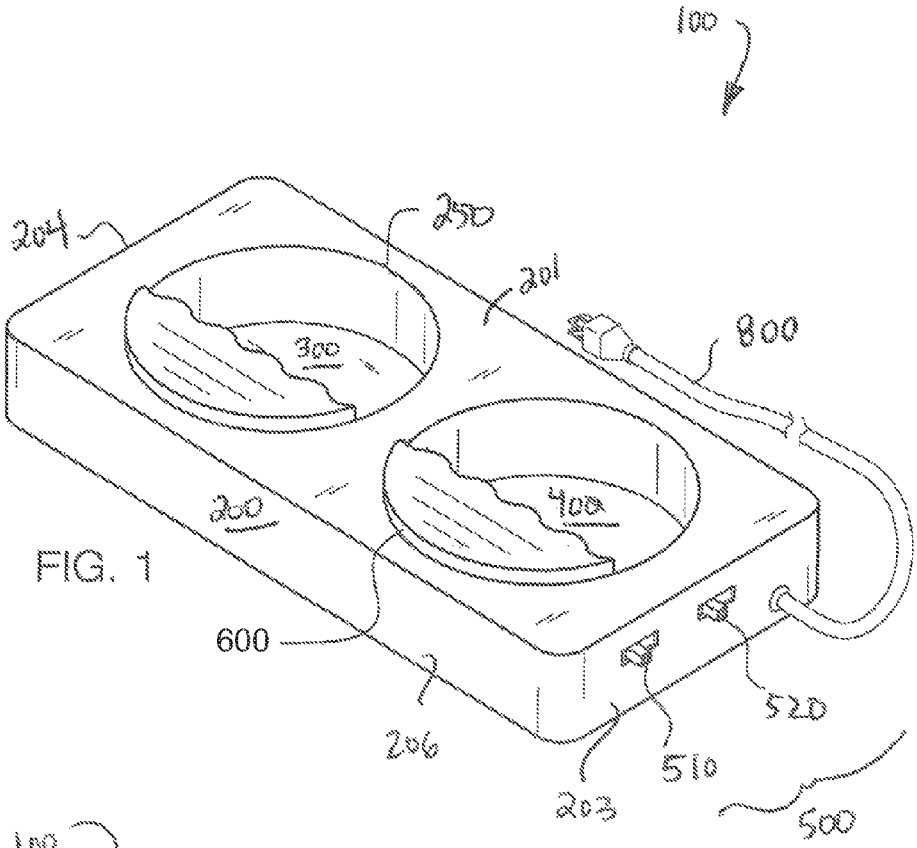
FIG. 1 is a perspective view of the spa manicure apparatus of the present invention.
Figure 2:
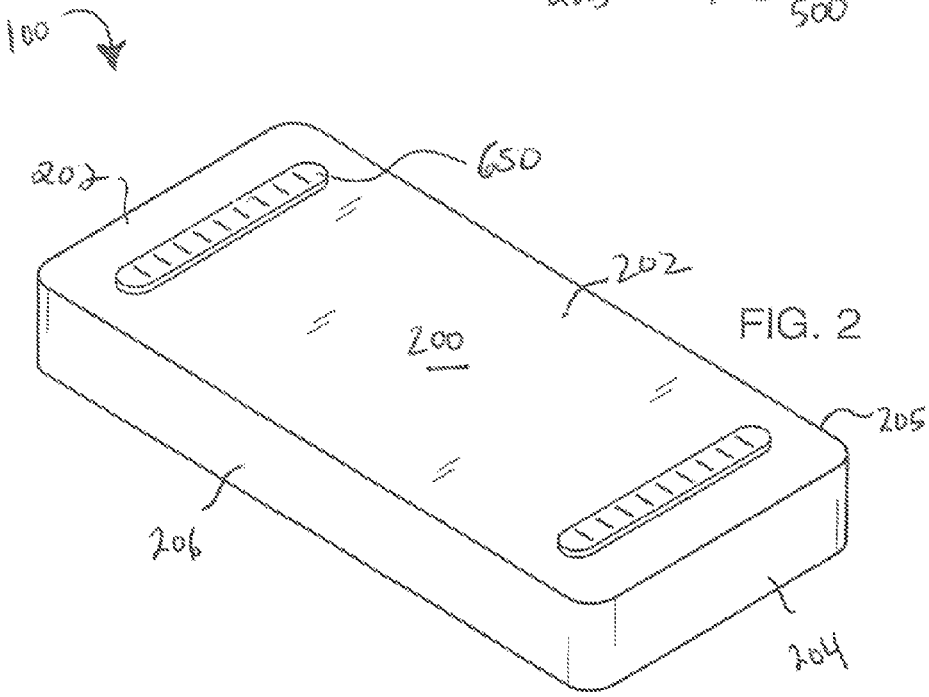
FIG. 2 is a perspective view of the bottom surface of the spa manicure apparatus of the present invention.
Figure 3:
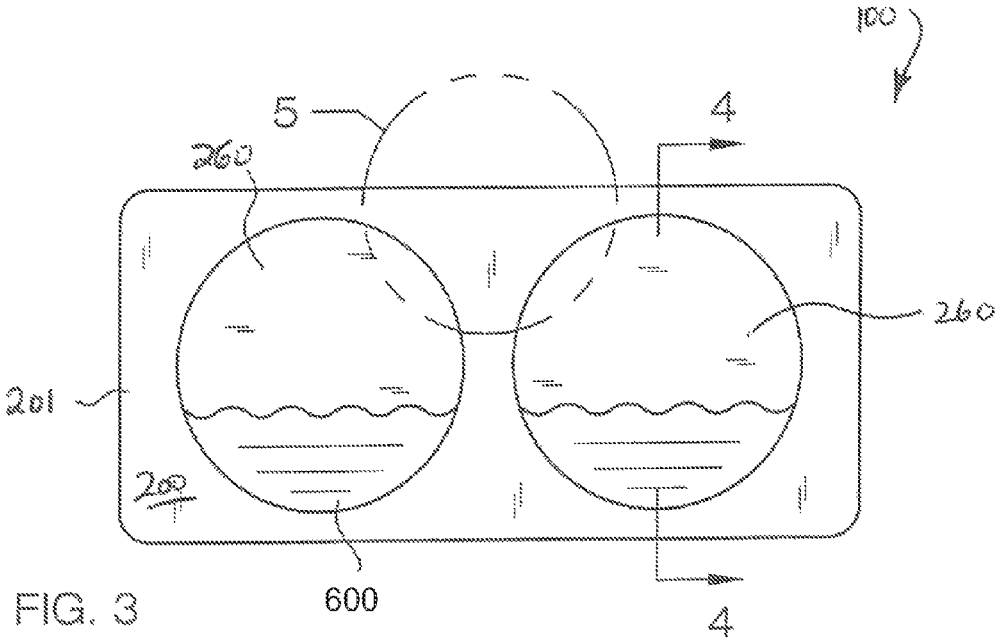
FIG. 3 is a top view of the spa manicure apparatus of the present invention.

The following is a listing of numbers corresponding to a particular element refer to herein:

100 spa manicure apparatus
200 housing
201 top surface of housing
202 bottom surface of housing
203 first side of housing
204 second side of housing
205 third side of housing
206 fourth side of housing

250 rim of basin
260 bottom surface of basin
270 notch
300 left basin
400 right basin
450 heating element
500 control panel
510 heating element activating button
520 massage element activating button
550 motor
560 wing
600 wrist rest
650 footing
700 solution (e.g., water)
800 power cord The present invention is directed to an apparatus for assisting in the preparation of hands, cuticles, and/or the like during a manicure process. The present invention allows a user to submerge both his/her hands into a warmed solution 700. The present invention also allows a user to have both his/her hands massaged throughout the manicure process. The present invention features a heating element 450 for heating the solution 700; thus, the present invention also allows a user to submerge both his/her hands into a warmed solution 700 for an extended period of time without needing to replace the solution 700.

Referring now to FIGS. 1-5, the present invention features a spa manicure apparatus 100 for providing comfort to a user's hands during a manicure. The spa manicure apparatus 100 comprises a housing 200 having a top surface, a bottom surface, a center, a first side, a second side, a third side, and a fourth side. The spa manicure apparatus 100 comprises a right basin 400 disposed in the top surface of the housing 200 near the first side, wherein the right basin 400 has a top rim 250 and a bottom surface. The right basin 400 is for retaining a solution 700 and for accepting a user's hand. The spa manicure apparatus 100 comprises a left basin 300 disposed in the top surface of the housing 201 near the second side, wherein the left basin 300 has a top rim 250 and a bottom surface. The left basin 300 is for retaining a solution 700 and for accepting a user's hand.

Figure 5:
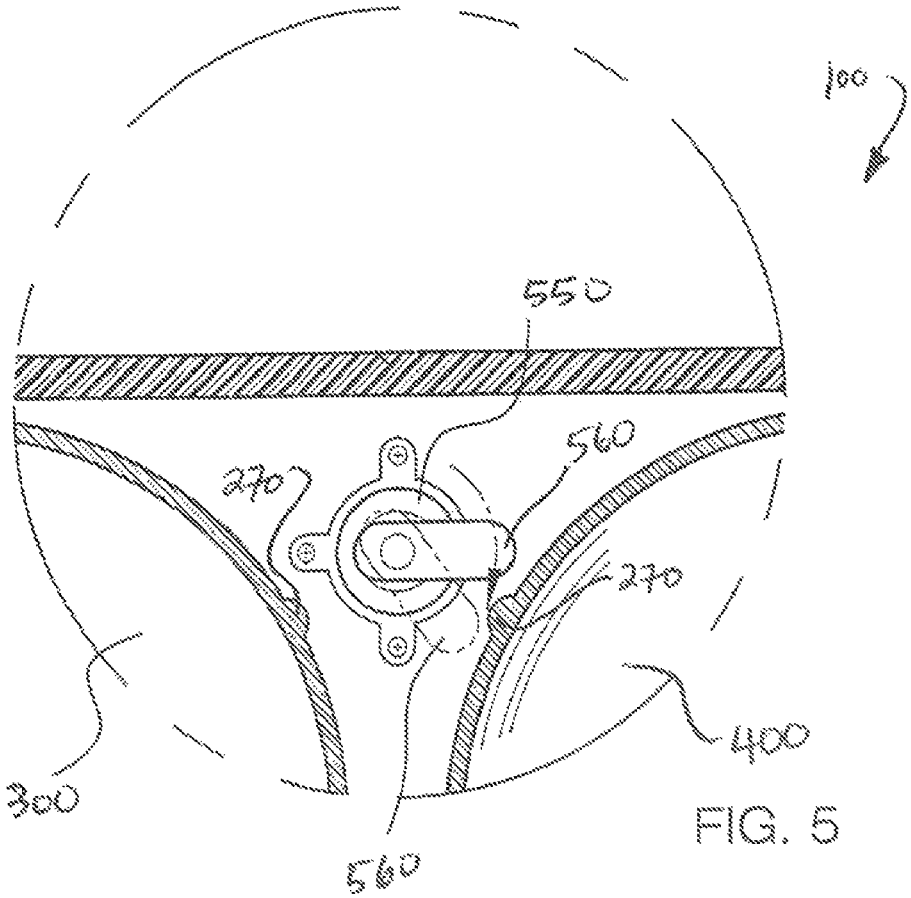
FIG. 5 is a top view and internal view of the spa manicure apparatus of the present invention.

In some embodiments, a notch 270 is disposed on the rim 250 of the right basin 400 and the rim 250 of the left basin 300 (see FIG. 5). In some embodiments, a notch 270 is disposed on the rim 250 of the right basin 400 near the center of the housing 200 near the fourth edge of the housing 206. In some embodiments, a notch 270 is disposed on the rim 250 of the left basin 300 near the center of the housing 200 near the fourth edge of the housing 206.

A wrist rest 600 is disposed on both the top rim 250 of the left basin 300 and on the top rim 250 of the right basin 400. In some embodiments, the wrist rest 600 is disposed on the top rim 250 of the right basin 400 and on the top rim 250 of the left basin 300 near the third side of the housing 205 (see FIG. 3). The wrist rest 600 is for allowing a user to rest his/her wrist on the top rim 250 of the right basin 400 and on the top rim 250 of the left basin 300.

Figure 4:
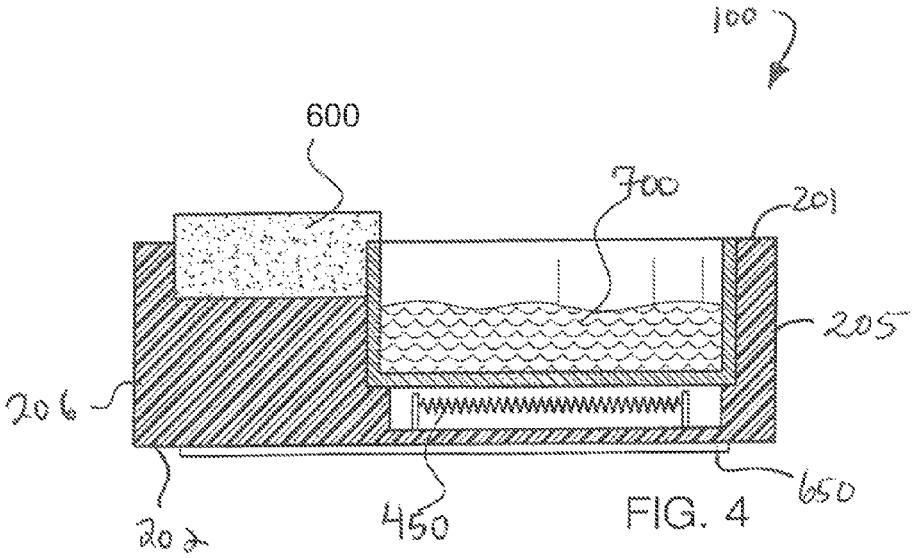
FIG. 4 is a side view and cross sectional view of the spa manicure apparatus of the present invention.

A heating element 450 is disposed in the housing 200 below both the bottom surface 260 of the left basin 300 and the bottom surface 260 of the right basin 400 (see FIG. 4). The heating element 450 is for heating the solution 700 retained in the left basin 300 and the right basin 400.

A massaging element is disposed in the housing 200, wherein the massaging element is for massaging the user's hands or wrists. In some embodiments, the massaging element is disposed in the center of the housing 200 near the fourth side of the housing 206.

The massaging element comprises a motor 550 having a top end and a bottom end. The bottom end of the motor 550 is attached to the bottom surface of the housing 202, and a wing 560 is disposed at the top end of the motor 550. The motor 550 spins the wing 560 in a clockwise or counterclockwise direction. The wing 560 can spin freely about the axis of the motor 550. As the wing 560 spins, it collides with the notches disposed on the left basin 300 and on the right basin 400. The collisions cause the notches to vibrate. In some embodiments, the collisions cause the notches and the left basin 300 and the right basin 400 to vibrate. These vibrations provide for the massaging of the user's hands and/or wrists.

The spa manicure apparatus 100 further comprises a control panel 500. In some embodiments, the control panel 500 is disposed on the first side of the housing 203, the second side of the housing 204, the third side of the housing 205, the fourth side of the housing 206, the top surface of the housing 201, or a combination thereof. The control panel 500 includes a heating element activating button 510 for activating or deactivating the heating element 450, and the control panel 500 includes a massaging element activating button 520 for activating or deactivating the massaging element.

In some embodiments, one or more footings 650 are disposed on the bottom surface of the housing 202. In some embodiments, footings 650 are for preventing the housing 200 from slipping/sliding on the surface onto which it is placed. In some embodiments, the footings 650 are constructed from a material comprising a plastic, a rubber, a foam, the like, or a combination thereof.

Without wishing to limit the present invention to any theory or mechanism, it is believed that the heating element 450 eliminates the need to replace the solution 700 in the basins with warm water because the heating element 450 maintains the temperature of the water.

In some embodiments, the heating element 450 is electrically connected to the heating element activating button 510 via a wire. In some embodiments, the massaging element is electrically connected to the massaging element activating button 520 via a wire.

In some embodiments, the heating element 450 and the massaging element are electrically connected to a power source. In some embodiments, the control panel 500 is electrically connected to a power source. In some embodiments, power source includes an electrical outlet and power cord 800, a battery, the like, or a combination thereof.

In some embodiments, the spa manicure apparatus 100 is constructed from a material comprising a plastic (e.g., a heat-resistant plastic), a metal (e.g., aluminum), a rubber, the like, or a combination thereof. In some embodiments, the wrist rest 600 is constructed from a material comprising a foam, a fabric the like, or a combination thereof.

As used herein, the term "about" refers to plus or minus 10% of the referenced number. For example, an embodiment wherein the basin is about 5 inches in diameter includes a basin that is between 4.5 and 5.5 inches in diameter.

The left basin 300 and/or the right basin 400 may be constructed in a variety of shapes and/or sizes. For example, in some embodiments, the left basin 300 and/or the right basin 400 are constructed in the shape of a circle, an oval, a rectangle, the like, or a combination thereof.

In some embodiments, the depth of the right basin 400 and/or the left basin 300 is between about 3 to 5 inches as measured from the top rim 250 to the bottom surface. In some embodiments, the depth of the right basin 400 and/or the left basin 300 is between about 5 to 8 inches as measured from the top rim 250 to the bottom surface.

In some embodiments, the left basin 300 and/or the right basin 400 are between about 5 to 7 inches in diameter. In some embodiments, the left basin 300 and/or the right basin 400 are between about 7 to 10 inches in diameter.

The housing 200 may be constructed in a variety of shapes and/or sizes. For example, in some embodiments, the housing 200 is constructed in the shape of a circle, an oval, a rectangle, the like, or a combination thereof.

In some embodiments, the housing 200 is between about 6 to 8 inches long as measured from the first side to the second side. In some embodiments, the housing 200 is between about 8 to 10 inches long as measured from the first side to the second side. In some embodiments, the housing 200 is between about 10 to 12 inches long as measured from the first side to the second side.

In some embodiments, the housing 200 is between about 10 to 12 inches wide as measured from the third side to the fourth side. In some embodiments, the housing 200 is between about 12 to 15 inches wide as measured from the third side to the fourth side. In some embodiments, the housing 200 is between about 15 to 20 inches wide as measured from the third side to the fourth side.

The following the disclosures of the following U.S. Patents are incorporated in their entirety by reference herein: U.S. Pat. No. 6,309,366 B1; U.S. Pat. No. 4,057,053; U.S. Pat. No. 6,695,800 B1; U.S. Pat. No. 6,725,471 B2; U.S. Pat. No. 6,973,683 B2; U.S. Pat. No. 7,165,555 B2.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A spa manicure apparatus (100) for providing comfort to a user's hands or wrists during a manicure, said spa manicure apparatus (100) consisting of:

(a) a housing (200) having a top surface (201), a bottom surface, a center, a first side, a second side, a third side, and a fourth side;

(b) a right basin (400) disposed in the top surface of the housing (201) near the first side, said right basin (400) for retaining a solution (700) and for accepting a user's hand, said right basin (400) having a top rim (250) and a bottom surface; wherein a first notch (270) is disposed on the top rim (250) of the right basin (400) located near the center of the housing (200) and near the fourth side of the housing (206);

(c) a left basin (300) disposed in the top surface of the housing (201) near the second side, said left basin (300) for retaining a solution (700) and for accepting a user's hand, said left basin (300) having a top rim (250) and a bottom surface; wherein a second notch (270) is disposed on the top rim (250) of the left basin (300) located near the center of the housing (200) and near the fourth side of the housing (206);

(d) a wrist rest (600) disposed on both the top rim (250) of the left basin (300) and on the top rim (250) of the right basin (400), wherein the wrist rest (600) is for allowing a user to rest his/her wrist on the top rim (250) of the right basin (400) and on the top rim (250) of the left basin (300);

(e) a heating element (450) disposed in the housing (200) below both the bottom surface of the left basin (300) and the bottom surface of the right basin (400), wherein the heating element (450) does not contact the left basin (300) or the right basin (400), wherein the heating element (450) is for heating the solution (700) retained in the left basin (300) and the right basin (400);

(f) a massaging element for massaging the user's hands or wrists, said massaging element disposed in the housing (200) near the center of the housing (200) and near the fourth side of the housing (206); wherein the massaging element comprises a motor (550) having a top end and a bottom end, wherein the bottom end of the motor (550) is attached to the bottom surface of the housing (202); wherein a wing (560) is attached to the top end of the motor (550), wherein the wing (560) can spin freely about the axis of the motor (550); wherein as the wing (560) spins, the wing (560) collides with the first notch (270) disposed on the right basin (400) and with the second notch (270) disposed on the left basin (300), wherein the collisions cause the notches, the left basin (300), and the right basin (400) to each vibrate;

(g) a control panel (500) disposed on the first side of the housing (203) or on the second side of the housing (204) or on the third side of the housing (205) or on the fourth side of the housing (206), said control panel (500) including a heating element activating button (520) for activating or deactivating the heating element (450), said control panel (500) including a massaging element activating button (250) for activating or deactivating the massaging element; and (h) a power source electrically connected to the heating element (450) and to the massaging element.

* * * * *